US006109600A

United States Patent [19]

Yost et al.

[11] Patent Number: 6,109,600

[45] Date of Patent: Aug. 29, 2000

[54] APPARATUS FOR SUPPORTING A WORKPIECE

[75] Inventors: Brian P. Yost, 1249 McGavock Pike, Nashville, Tenn. 37216; Robert J. Budesa, Hermitage, Tenn.

[73] Assignee: Brian P. Yost, Nashville, Tenn.

[21] Appl. No.: 08/994,478

[22] Filed: Dec. 19, 1997

(Under 37 CFR 1.47)

Related U.S. Application Data

[63] Continuation of application No. 08/602,221, Feb. 16, 1996, abandoned.

[51] Int. Cl.[7] ..... B66F 3/00

[52] U.S. Cl. ..... 269/17; 269/95; 269/131; 269/132; 269/296; 269/285; 269/47

[58] Field of Search ..... 118/500–503; 187/220, 216, 203, 219, 218; 108/6, 28; 211/196, 169.1; 269/17, 285, 296, 95, 47, 131, 132; 254/DIG. 16, 133, 134

[56] References Cited

U.S. PATENT DOCUMENTS

| | | | |
|---|---|---|---|
| 135,593 | 2/1873 | Rykert | 118/500 |
| D. 325,505 | 4/1992 | Hernandez . | |
| D. 338,820 | 8/1993 | Sheftel . | |
| 1,349,633 | 8/1920 | Staley . | |
| 1,792,612 | 2/1931 | Staley . | |
| 2,786,549 | 3/1957 | Tozloski | 187/220 |
| 2,997,292 | 8/1961 | Lucker et al. | 269/17 |
| 3,220,565 | 11/1965 | Wells | 269/17 |
| 3,643,935 | 2/1972 | Bell . | |
| 3,948,484 | 4/1976 | Tesinsky | 254/134 |
| 4,029,308 | 6/1977 | Mathers . | |
| 4,520,981 | 6/1985 | Harrigan . | |
| 4,659,072 | 4/1987 | De La Rosa . | |
| 5,127,359 | 7/1992 | Kannari et al. . | |
| 5,135,205 | 8/1992 | Bedard . | |
| 5,141,211 | 8/1992 | Adams, Jr. . | |
| 5,294,098 | 3/1994 | Bundy | 269/17 |
| 5,358,217 | 10/1994 | Dach | 254/134 |

OTHER PUBLICATIONS

E–Z Marketing Product Brochure, Portable Workbenches, 3 pages.

Combo–Carts Product Brochure, Portable Automobile Body Parts Rack, 3 pages.

*Primary Examiner*—Robert C. Watson
*Attorney, Agent, or Firm*—Shanks & Herbert

[57] ABSTRACT

An apparatus for supporting a workpiece, such as an automobile bumper, comprising a support base, a top frame attached thereto, a crossbar mounted to the top frame for supporting the workpiece and a stabilizing device for securing the workpiece to the apparatus. The top frame further comprises a central portion and a plurality of arms extending therefrom. The plurality of arms may further comprise a first pair of spaced apart arms each having a first end attached to the support base and a free second end opposite the first end. A crossbar is attached to each of the free second ends of the pair of spaced apart arms. The apparatus further includes a stabilizing device attached to the apparatus for stabilizing the workpiece positioned thereon. The apparatus may include an adjustment mechanism comprising a rod having spaced apart ends received within a pair of aligned bores, and a retainer positioned intermediate the ends for positioning the top frame in a plurality of user selectable orientations. The apparatus may further include cushions removably attached to the crossbar for protecting the workpiece, and an optional adapter removably mounted to the crossbar to aid in the positioning of the workpiece.

14 Claims, 9 Drawing Sheets

APPARATUS FOR SUPPORTING A WORKPIECE

This application is a continuation of application Ser. No. 08/602,221 filed Feb. 16, 1996, now abandoned in the name of Robert J. Budesa and Brian P. Yost.

BACKGROUND OF THE INVENTION

1. Field of the Invention

The present invention relates generally to apparatuses for supporting a workpiece, such as an automobile body part, including a bumper, positioned thereon. More particularly, the present invention relates to such apparatuses incorporating a support base, a top frame, and a stabilizing device for stabilizing the workpiece.

2. Description of the Related Art

The manufacture and repair of automobile body parts invariably involves painting the parts to achieve the finished product. Because of their configuration and unwieldy nature, certain body parts, such as bumpers, may require repositioning and painting in phases in order to obtain an even and professional finish. After each phase of painting, the bumper must often be manually repositioned in order to paint portions of the bumper that were inaccessible during previous phases due to interference of holding clamps or other supporting structures. Accordingly, additional time and labor are required to allow for this repeated painting and drying, and for repeated repositioning of the part.

Many of the commercially available devices for supporting workpieces, particularly bumpers, do not address the problems associated with having to repeatedly reposition the workpiece during the refinishing process, steps which require additional time and labor.

U.S. Pat. No. 4,520,981 granted to Harrigan and incorporated by reference as if fully set forth herein is directed to an adjustable telescopic support having a standard providing a hollow core, an elongated telescoping slide bar movable within the hollow core of the standard with the slide bar providing a tapered face extending downwardly and inwardly within the standard. The standard provides an adjustable member threadable into the hollow core of the standard for engaging the tapered face of the telescoping slide bar for adjustably maintaining the telescopic position of the slide bar within the hollow core of the standard. A base is provided for maintaining the standard in a vertical plane. The Harrigan device only provides for adjustment of the vertical position of the workpiece.

U.S. Pat. No. 5,127,359 granted to Kannari et al. and incorporated by reference as if fully set forth herein is directed to a work holding apparatus for holding a work to be coated such as a bumper for an automobile while rotating the work. The work holding apparatus includes a frame mounted for rotation on a support member, a work holding member mounted on the frame by means of a support bar extending perpendicularly to the longitudinal direction of a work, and drive mechanism for rotating the frame. An axis of rotation of the frame is disposed substantially at a central position of a work held on the work holding member along a width of the work in a direction perpendicular to the longitudinal direction of the work.

U.S. Pat. No. Des. 338,820 granted, to Sheftel and incorporated by reference as if fully set forth herein is a design patent directed to an adjustable work holder comprising a three-legged base supporting a vertically adjustable T-shaped member for holding a workpiece. Similar to the Harrigan device, the Sheftel device only provides for adjustment of the vertical position of the workpiece.

U.S. Pat. No. Des. 325,505 granted to Hernandez and incorporated by reference as if fully set forth herein is a design patent directed to a door mounting stand having a base, an upright member extending upwardly therefrom, and a pair of vertically adjustable opposing clamps for supporting a door therebetween.

A device sold by E-Z Marketing of Erie, Pa., under the trade designation EZ PORTA-BENCH comprises a pair of inverted U-shaped tubular members pivotally attached at the midpoints of the upright portions. The U-shaped members open such that the bottom portions of the members form horizontal parallel supports for a workpiece. The horizontal supports are covered with foam padding along their length to prevent scratching of painted workpieces. The EZ PORTA-BENCH device does not include structure for changing the elevation or position of the workpiece.

A device sold by Combo-Carts of Springfield, Ill., under the trade designation COMBO-CARTS comprises a rack for mounting auto body parts to be painted. The rack comprises a frame having a base and upright supports to which a plurality of racks configured to accommodate various auto body parts are mounted. The frame is mounted on casters for ease of mobility. The rack for mounting an automobile bumper is adjustable to only three positions. Moreover, due to its overall size, the COMBO-CART cannot typically be placed in a paint booth with a vehicle.

A device sold by Brut Manufacturing Company of Navarre, Ohio, under the trade designation THE BUMP-BENCH, comprises a collapsible rack having a pair of spaced apart, parallel U-shaped members which form a bracket on which an automobile bumper may be positioned. The bracket is supported on a telescoping upright member mounted on an base comprising an elongated member having spaced apart ends and legs mounted perpendicularly thereto to form an I-shaped configuration. Wheels are rotatably attached at the ends of one leg of the base. While the BUMP-BENCH device permits adjustment in the vertical plane, it does not include structure for adjusting the orientation of the workpiece itself.

Accordingly, it is believed that an apparatus for supporting a workpiece comprising a base, an upright member and adjustable workpiece support means for facilitating unobscured access to the entire workpiece would be desirable. It is further believed that, until now, such an apparatus has not been invented.

SUMMARY OF THE INVENTION

The apparatus of the present invention overcomes the limitations inherent in the devices described hereinabove in that it permits the user to adjust the elevation as well as the angular disposition of the workpiece. Direct contact with the workpiece is not required in order to reorient or reposition the workpiece to reach portions that might otherwise be inaccessible to a worker using conventional devices comprising the art to which the invention relates. The ability to adjust the position of the workpiece without direct contact with the workpiece is desirable in that the time and labor costs associated with performing work, such as refinishing or repairing, the workpiece are believed to be minimized as a result. Moreover, the apparatus of the present invention is configured to engage the inner surface of the workpiece, thus, the entire outer surface of the workpiece is accessible for refinishing, painting or repair.

The apparatus is preferably constructed of square tubular steel, however, other rigid, high strength materials, including other metals, plastics or composites, or other configurations such as round tubing, are contemplated to be within the scope of the present invention.

An embodiment of the present invention includes a support base, a top frame attached to the support base, a crossbar attached to the top frame, and a stabilizing device attached to the apparatus for stabilizing the workpiece, such as an automobile bumper, positioned thereon.

The support base includes an upright support member and a plurality of legs extending therefrom. The plurality of legs may further include a first pair and a second pair of spaced apart legs. Alternatively, the support base may include a pair of oppositely disposed leg frames attached to the upright support member, each leg frame having a central portion and at least one leg extending therefrom.

In the preferred embodiment, the leg frames each have a first leg and a second leg extending angularly outward from the central portions of the leg frame to form a pair of short legs and a pair of long legs. Accordingly, the base preferably forms a substantially H-, I-, Y-, T- or X-shaped configuration; however, other suitable configurations are contemplated to be within the scope of the present invention such that the base may be configured in any manner that will provide the stability necessary to support the apparatus when a workpiece is mounted thereon.

For example, the base may comprise a leg frame having forward and rear legs extending angularly therefrom, it may comprise a leg frame having crossmembers attached perpendicularly at spaced apart ends of the leg frame to form a substantially I-shaped base configuration. Alternatively, the base may simply be a flat base plate.

In the preferred embodiment, the pair of long legs include casters or wheels mounted at their terminal ends for mobilizing the apparatus. The short legs, on the other hand, rest directly on a floor or ground surface. The apparatus may be easily relocated by merely elevating the short legs off of the floor or ground surface and moving the apparatus on the casters or wheels on the long legs.

The upright member or strut is preferably rigidly attached to the plurality of legs or to the leg frames at a lower end. In the preferred embodiment, the upright member is interpositioned between the oppositely disposed leg frames of the base. A reinforcing member or reinforcing means may comprise, for example, an L-shaped member or a pair of plates rigidly attached to the upright member and the plurality of legs or the leg frames to provide additional stability.

A top frame is pivotally attached to the upper end of the upright member, and the upright member is interpositioned between the oppositely disposed arm frames partially comprising the top frame.

The top frame preferably comprises a central portion and a plurality of arms extending therefrom. The plurality of arms further comprise a first pair of spaced apart arms, each arm having a first end attached to the support base and a free second end opposite the first end. A crossbar for supporting the workpiece is attached to each of the free second ends of the pair of spaced apart arms. The plurality of arms may also include a second pair of spaced apart arms.

Alternatively, the top frame comprises a pair of oppositely disposed arm frames, each arm frame having a central portion and at least one arm extending therefrom. In the preferred embodiment, the arm frames each have a first arm and a second arm extending angularly outward from the central portions of the arm frame to form a pair of short arms and a pair of long arms. Accordingly, the base forms a substantially H-, I-, Y-, T- or X-shaped configuration; however, other suitable configurations are contemplated to be within the scope of the present invention. For ease of manufacturing, the top frame is preferably a reversed mirror image of the base; thus, the top frame of the preferred embodiment is rotated such that the short arms are vertically aligned with the long legs, and the long arms are vertically aligned with the short legs.

A crossbar may also be provided to form a single unit merging with each arm frame. Alternatively, the crossbar may comprise two separate independent crossbars, each of which is pivotally attached to the terminal end of a pair of the plurality of arms. With this embodiment, each of the two crossbars may be pivoted outward such that a workpiece may be mounted on the protruding ends thereof.

The top frame may further include a reinforcing member or reinforcing means which functions to limit the pivotal movement of the top frame, attached to thereto. In the preferred embodiment, the reinforcing member comprises an L-shaped member interpositioned between and rigidly attached to the oppositely disposed arm frames such that a portion of the "L" is parallel to a longitudinal axis of the arm frames and the other perpendicular portion of the "L" extends perpendicularly downward therefrom. The downwardly extending portion of the "L" is aligned to directly engage the upright support member to limit downward travel of the top frame.

In an alternate embodiment, the reinforcing means may comprise a pair of spaced apart parallel plates rigidly mounted to the top frame. In this embodiment, a bolt or pin extending perpendicularly through the plates forward of the upright member limits the range of pivotal movement of the workpiece support means.

One acceptable embodiment of the stabilizing device of the preferred embodiment includes a pair of chains, each having one end attached to the top frame and an opposite end attached to the workpiece. The stabilizing device is configured to enable the user to eliminate slack in the chain when attached to the workpiece. In the preferred embodiment, each chain includes a hook attached intermediate its ends. The free end of the hook can be attached to the chain at the appropriate point along its length to "take up" any slack.

The apparatus may also include an adjustment mechanism or adjustment means for operatively positioning the top frame in a plurality of user selectable orientations with respect to the support base. The adjustment mechanism comprises a rod having a cooperative retainer intermediate spaced apart ends. In the preferred embodiment, the adjustment mechanism comprises an elongated threaded rod having a cooperatively threaded retaining nut intermediate the spaced apart ends. One end of the threaded rod is received within an angled bore through the base, preferably positioned at the upper end of the upright support member. The opposite end of the threaded rod is received within an aligned bore in the top frame. In the preferred embodiment, the aligned bore in the top frame extends through the downwardly extending portion of the L-shaped reinforcing member. The retaining nut is positioned on the threaded rod to abut the upright support between the base and the top frame to hold the apparatus in a preselected position. Alternatively, the retainer may comprise a friction release retainer which is biased into position onto the rod. The retainer may be released to move the retainer along the length of the rod to the desired position.

An optional adapter may also be provided for facilitating the mounting of workpieces of various configurations. In the preferred embodiment, the adapter comprises a pair of sleeves. Each sleeve has a hollow interior configured to receive and to slidably engage the crossbar. Each sleeve further includes an angularly extending post merging with the sleeve to form a pedestal on which a workpiece may be positioned. The sleeves are, therefore, detachably mounted to the crossbar or crossbars, depending upon the embodiment, support member(s), and may include a fastener for preventing lateral movement of the sleeves on the crossbar(s). In the preferred embodiment, the fastener comprises a threaded screw or bolt extending through a threaded bore in a wall of the sleeve. The screw may be tightened causing it to enter the interior passageway of the sleeve such that it may directly engage the crossbar(s), thus securing the sleeves thereto in their installed position.

An alternate embodiment of the present invention includes a support base comprising an elongated upright support member pivotally attached to a top frame. Similar to the embodiments described above, the top frame may comprise oppositely disposed arm frames, each arm frame having a central portion and a plurality of arms extending therefrom forming a substantially H-, I-, Y-, T- or X-shaped configuration. Each arm frame includes a first arm and a second arm extending angularly outward from the central portions of the arm frame to form a pair of short arms and a pair of long arms. The pair of long arms of the top frame are pivotally attached to a bracket capable of being mounted to a wall or vertical support surface so that the apparatus may be operatively raised or lowered (collapsed) when not in use.

The bracket is preferably positioned on the wall or vertical support surface at a height slightly greater than the separating distance between the crossbar and the lower end of the upright support member or the arms of the top frame, whichever is longer. An optional leg rest may also be provided to receive a lower end of the upright support member. The leg rest may also be operatively mounted to the wall or other suitable support surface. The apparatus may be lowered and collapsed by disengaging the upright support member from the leg rest means when not in use such that the apparatus is substantially flush with the wall or support surface when not in use.

The present invention may, therefore, be summarized in a variety of ways, one of which is the following: an apparatus for supporting a workpiece such as a bumper during a painting or repair operation, the apparatus comprising a support base; a top frame pivotally attached to the support base; the top frame further comprises a central portion and a plurality of arms extending therefrom; the plurality of arms further comprises a first pair of spaced apart arms each having a first end attached to the support base and a free second end opposite the first end; and a crossbar attached to each of the free second ends of the pair of spaced apart arms.

The plurality of arms further comprises a second pair of spaced apart arms. The top frame further includes a pair of arm frames each having a central portion and at least one arm extending therefrom. The support base further comprises an upright support member. The upright support member further comprises a plurality of legs extending therefrom. The plurality of legs further comprises a plurality of legs extending therefrom, which may further comprise a first pair of spaced apart legs.

The apparatus may further comprise pivot means for pivotally attaching the top frame to the support base, and an adjustment mechanism enabling the top frame to be positioned in a plurality of user selectable orientations with respect to the support base. The adjustment mechanism further comprises a support rod extending through the upright support member at an angle relative thereto.

The apparatus may further include a stabilizing device attached to the apparatus for stabilizing the workpiece positioned thereon. Cushion means removably attached to the crossbar may be provided for protecting the workpiece. An optional adapter, which is removably mounted to the crossbar, may also be provided to aid in the positioning of the workpiece.

A second way of summarizing the invention is as follows: an apparatus for supporting a workpiece, comprising a base; at least one arm frame pivotally attached to the base; a crossbar attached to the at least one arm frame for supporting the workpiece; and a retaining system used to secure the workpiece to the apparatus.

The base further comprises an upright support member having a plurality of legs extending therefrom. The plurality of legs further comprises spaced apart pairs of legs. The apparatus further comprises a wheel system attached to a pair of the spaced apart pairs of legs enabling the workpiece positioned on the apparatus to be rolled to a suitable repair location by the user.

The at least one arm frame further comprises a pair of oppositely disposed arm frame members each having spaced apart ends extending therefrom to form at least one pair of arms. The retaining system comprises at least one chain; and attachment means for removably attaching the chain to the at least one arm frame and the workpiece. The crossbar may further comprise first and second independent crossbar sections.

The apparatus may further comprise an adjustment mechanism enabling the user to adjust the angular disposition and elevation of the at least one arm frame. The adjustment mechanism further comprises a rod having spaced apart ends; a retainer positioned on the rod intermediate the spaced apart ends; wherein one end of the rod is received within an axial bore in the base and the other end of the rod is received within an aligned bore in the at least one arm frame.

In an alternative embodiment of the invention, the base further comprises an upright support member having a first end pivotally attached to the arm frame; and the at least one arm frame further comprises a first pair of arms attached to the crossbar and a second pair of arms pivotally attached to a bracket capable of being mounted to a vertical support surface. The alternate embodiment may fierier comprise a leg rest attached to the vertical support surface for supporting a second end of the upright support member.

A third way of summarizing the invention is: an apparatus for supporting a workpiece, comprising a base and a top frame pivotally attached to the base, the top frame further including at least one arm frame having at least one pair of arms, each arm having a terminal end extending therefrom.

It is an object of the present invention to provide an apparatus for supporting a workpiece useful while performing work on the workpiece.

It is an object of the present invention to provide an apparatus for supporting a workpiece having a support base, a top frame pivotally attached thereto, a crossbar attached to the top frame, and a stabilizing device for stabilizing the workpiece positioned thereon.

It is an object of the present invention to provide an apparatus for supporting a workpiece wherein the top frame comprises a central portion and a plurality of arms extending therefrom.

It is an object of the present invention to provide an apparatus for supporting a workpiece wherein the base includes an upright support member and a plurality of legs extending therefrom.

It is an object of the present invention to provide an apparatus for supporting a workpiece having an adjustment mechanism for adjusting the elevation and angular disposition of the workpiece.

It is an object of the present invention to provide cushion means for protecting a workpiece mounted on the apparatus.

It is an object of the present invention to provide a wheel system for enabling the workpiece positioned on the apparatus to be rolled to a plurality of repair locations by the user.

It is an object of the present invention to provide an apparatus for supporting a workpiece having an adapter to facilitate the mounting of workpieces of various configurations on the apparatus.

It is an object of the present invention to provide a collapsible apparatus for supporting a workpiece configured for mounting on a wall or other vertical support surface.

These and other objects, features and advantages shall become apparent after consideration of the scope of the specification and drawings attached hereto. All such objects, features and advantages are contemplated as part of the present invention whose only limitation is the scope of the appended claims.

DETAILED DESCRIPTION OF THE PREFERRED EMBODIMENTS

Figure 1:
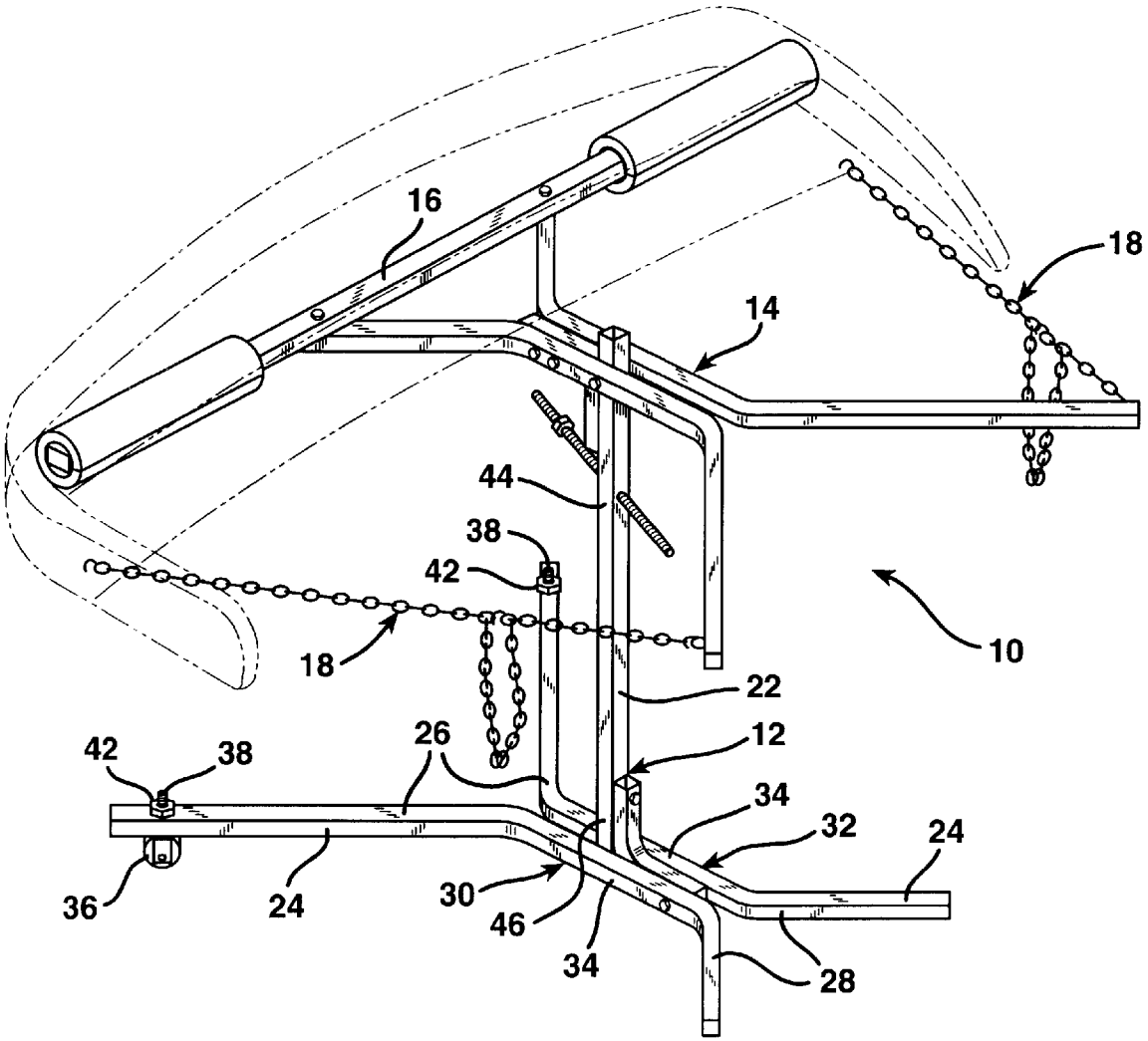
FIG. 1 is an elevated perspective view of an embodiment of the present invention with a workpiece shown in phantom.
Figure 2:
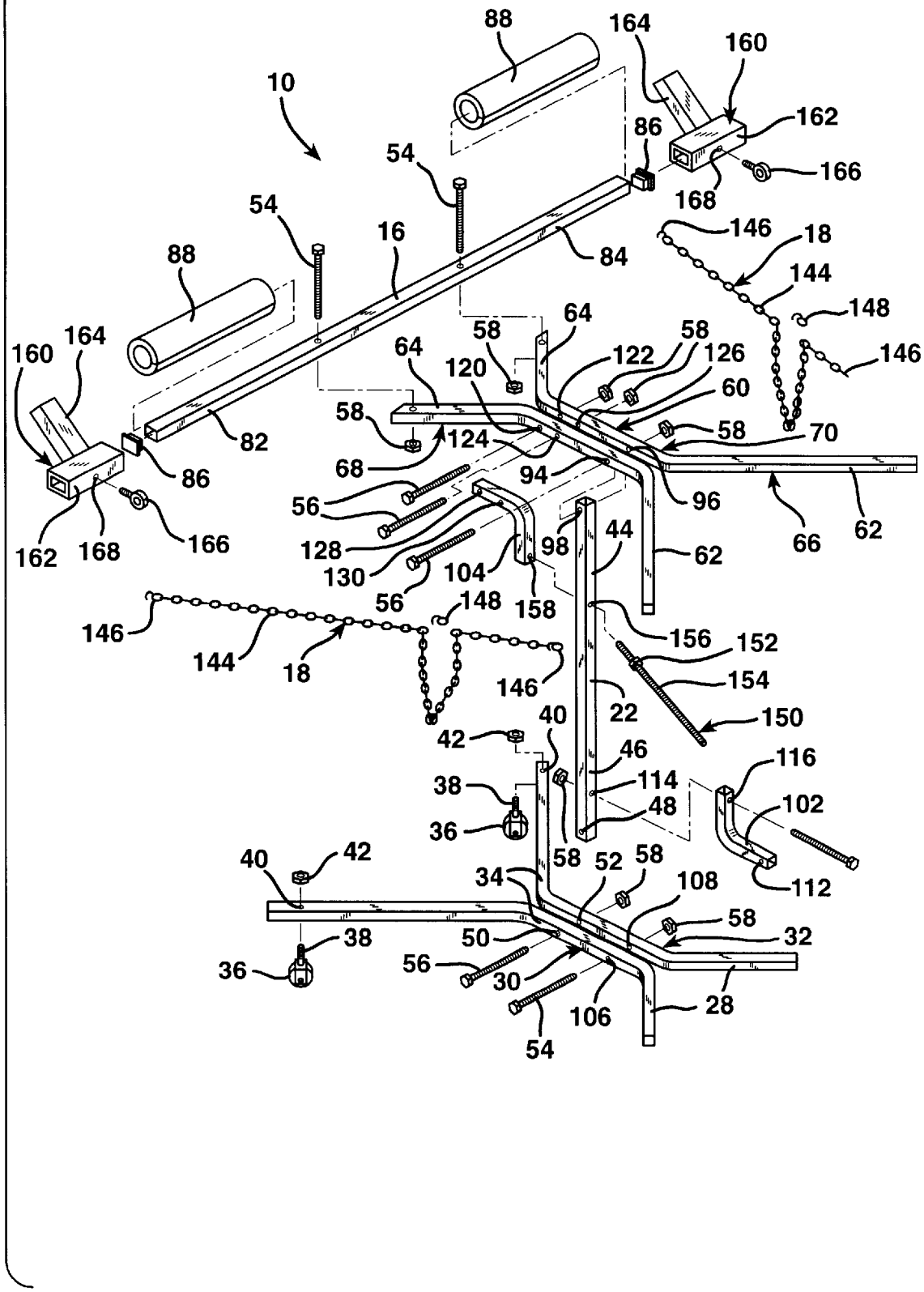
FIG. 2 is an exploded view of the embodiment of the invention shown in FIG. 1.

With reference to FIGS. 1 and 2, a preferred embodiment of the present invention is designated generally by the reference numeral 10. Preferred embodiment 10 includes a support base 12, a top frame 14 attached to the support base, a crossbar 16 attached to the top frame 14, and a stabilizing device 18 attached to the apparatus for stabilizing a workpiece 20 positioned thereon.

With reference to FIG. 2, the support base 12 comprises an upright support member 22 and a plurality of legs 24 extending therefrom. The plurality of legs 24 may include a first pair of legs 26 and a second pair of legs 28. In the preferred embodiment, the support base includes a pair of oppositely disposed leg frames 30 and 32 attached to the upright support member 22. The leg frames 30 and 32 further comprise a first pair of legs 26 and a second pair of legs 28 extending angularly outward from a central portion 34. The first pair of legs 26 are preferably longer than the second pair of legs 28. The two pairs of legs 26 and 28 are preferably splayed outwardly such that a substantially X-shaped base configuration is formed. However, alternative configurations are contemplated to be within the scope of the present invention so long as the configuration forms a stable base for supporting the workpiece 20 when supported on the top frame 14.

Figure 8:
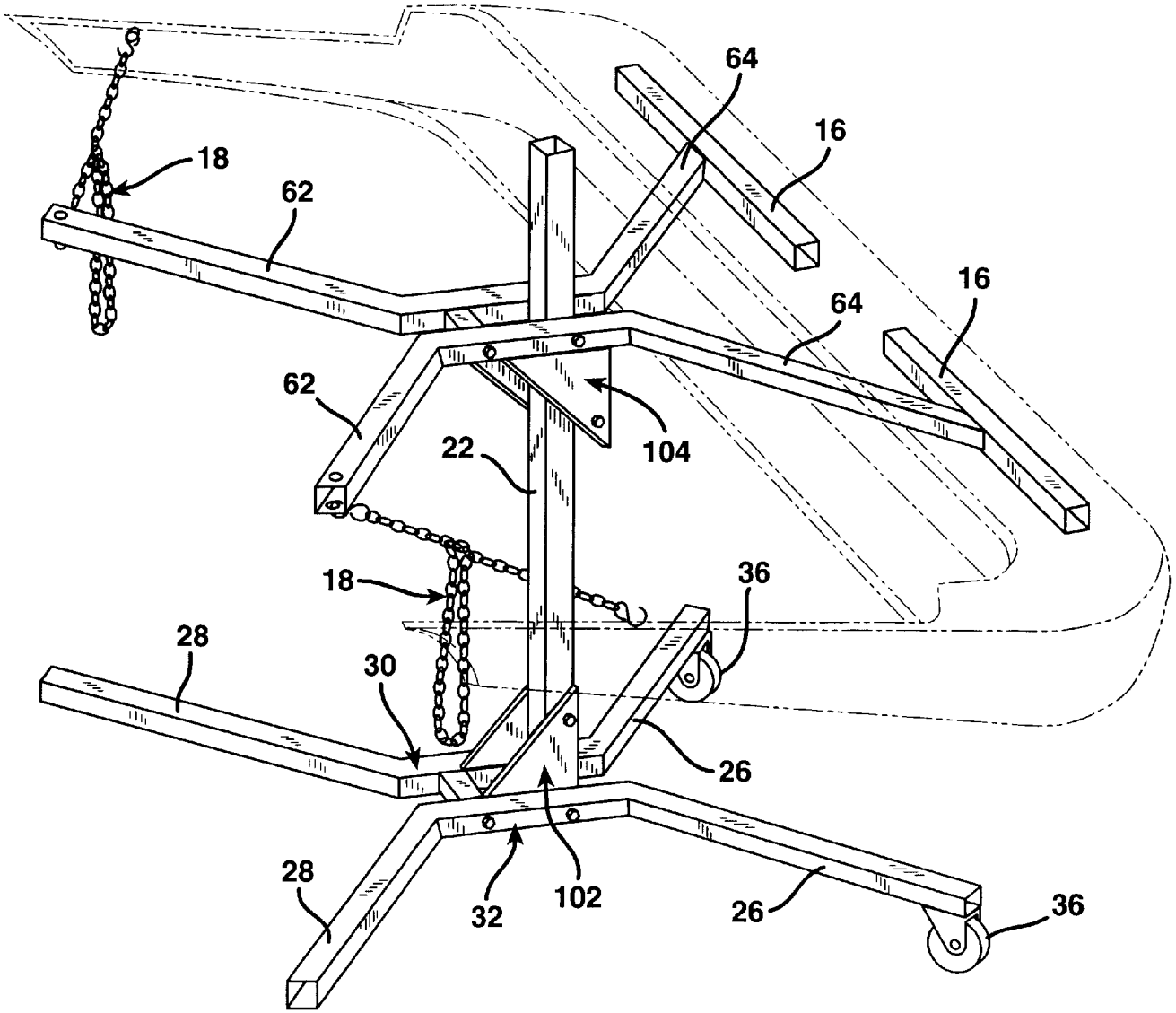
FIG. 8 is an elevated perspective view of the embodiment of the invention shown in FIG. 7 with a workpiece shown in phantom.
Figure 9:
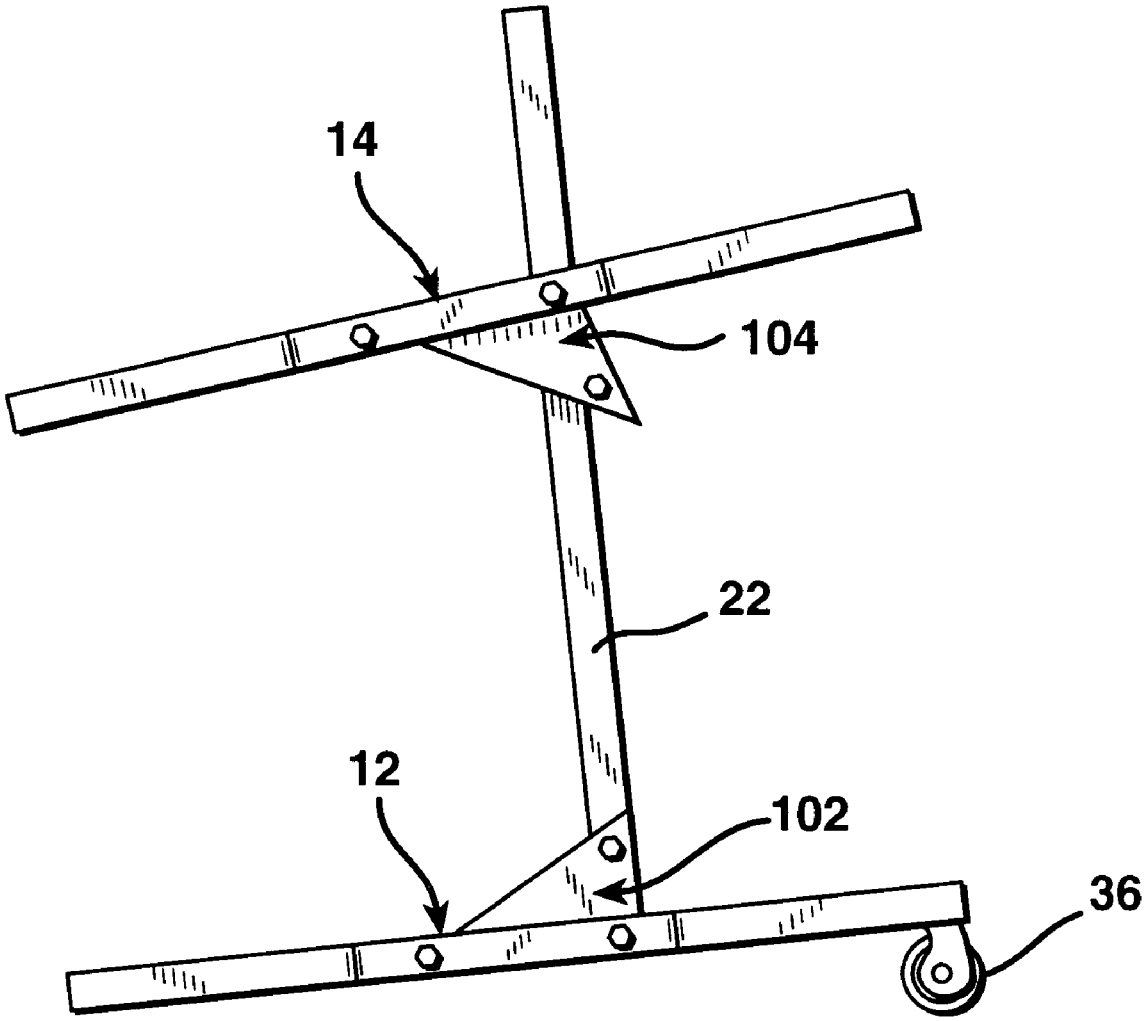
FIG. 9 is a side view of the embodiment of the invention shown in FIG. 7.

A wheel or caster 36 is operably attached at a terminal end of each long leg 26 (see FIGS. 1, 2 and 8). In the preferred embodiment, the caster 36 includes a threaded post 38 which extends upwardly through a bore 40 in the leg and threadably engages a nut 42 for securing the caster to the leg 26. However, other suitable means of operable attachment are contemplated to be within the scope of the present invention. Accordingly, the support base 12 is movable on the casters 36 when the short legs 28 of the support base 12 are elevated to disengage the floor or surface on which the apparatus 10 rests.

The elongated upright support member 22 includes an upper end 44 and a lower end 46. The lower end 46 of the upright support member 22 includes a bore 48 positioned to align with a pair of aligned bores 50 and 52 positioned at the central portion 34 of leg frames 30 and 32. The bores 48, 50 and 52 are configured to receive a fastener 54, such as a threaded bolt 56, for attaching the support base 12 to the upright member 22. A protruding end of the threaded bolt 56 is received within a cooperatively threaded nut 58. It is also contemplated that the support base 12 be attached to the upright member 22 by other suitable means of attachment, such as a weld.

A reinforcing member or reinforcing means are provided at the base to enhance the structural stability of the apparatus. The reinforcing means may comprise an L-shaped reinforcing member 102 rigidly attached to the upright support member 22 and the plurality of legs 24 or to the leg frames 30 and 32. In the preferred embodiment, the reinforcing member 102 is interpositioned between the leg frames 30 and 32 of the base 12 and is rigidly attached thereto by at least one fastener 54 extending perpendicularly through bores 106 and 108 in the leg frames 30 and 32, respectively, and bore 112 positioned at a terminal end of a first portion of the "L" of the reinforcing member 102. A second portion of the "L" of the reinforcing member 102 extends perpendicularly upward such that a longitudinal surface of the reinforcing member 102 directly engages the upright member 22. In a similar fashion, the upwardly extending second portion of the reinforcing member 102 is attached to the upright support member 22 by at least one fastener 54 extending through aligned bores 114 and 116 positioned at the lower end 46 of the upright member 22 and at the second portion of the reinforcing member 102, respectively. Alternatively, the reinforcing member 102 may be rigidly attached to the upright support member 22 by any other suitable means of attachment, such as welding.

Figure 7:
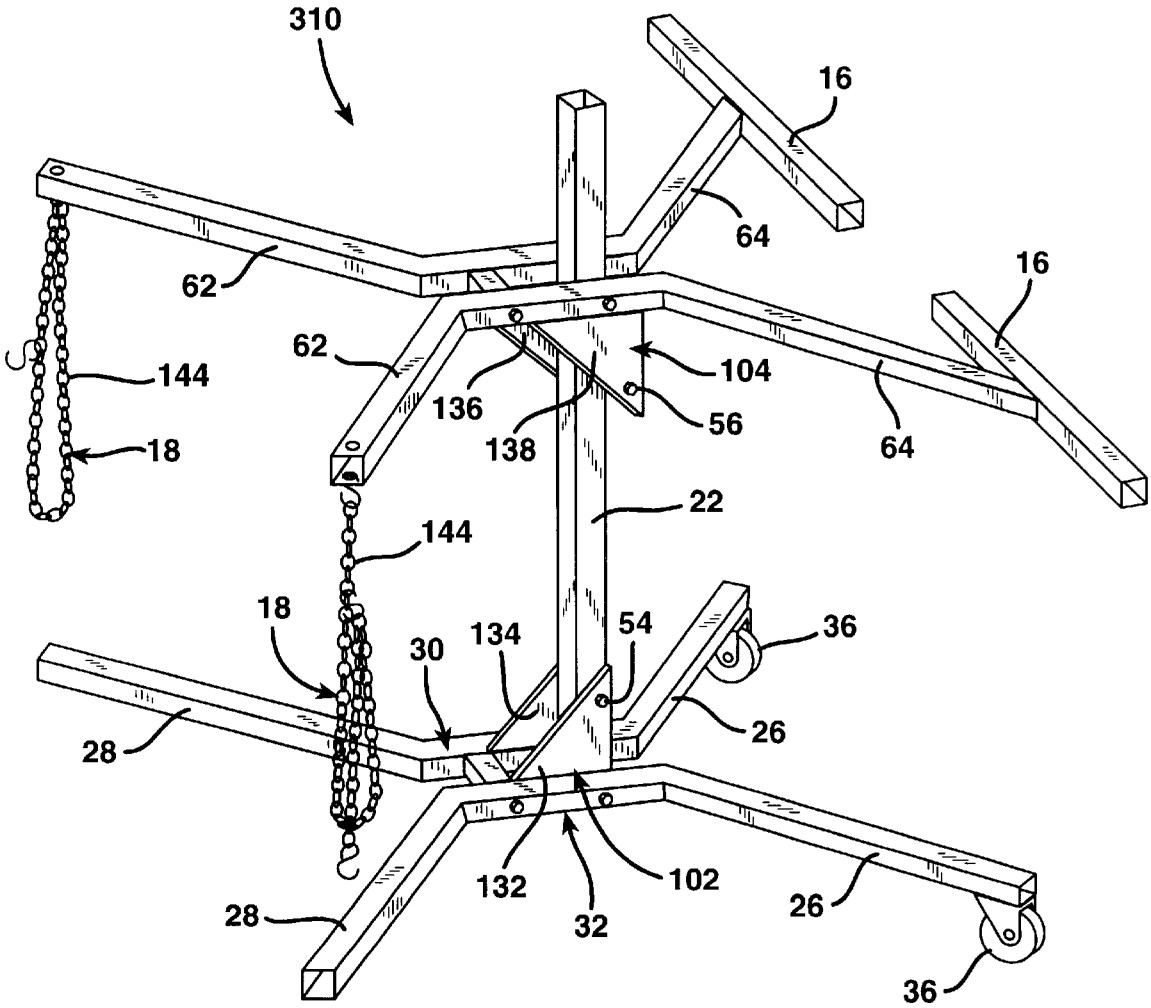
FIG. 7 is an elevated perspective view of an alternate embodiment of the present invention.

In an alternate embodiment of the invention designated generally by the reference number 310 in FIG. 7, reinforcing member 102 may comprise a pair of spaced apart parallel plates 132 and 134 rigidly mounted to the support base 12. The plates 132 and 134 may be attached by any suitable means of attachment, such as fasteners 54 or welds.

The top frame 14 further comprises a central portion 60 and a plurality of arms 62 extending therefrom. The plurality of arms 62 may further comprise a first pair of arms 64 and a second pair of arms 66. In the preferred embodiment, the top frame 14 is constructed to form an oppositely disposed mirror image of the support base 12. Accordingly, the top frame 14 further comprises a pair of oppositely disposed arm frames 68 and 70, each arm frame having a first arm and a second arm extending angularly outward from a central portion 60 such that a pair of short arms 64 and a pair of long arms 66 are formed. In the preferred embodiment, the pairs of arms 64 and 66 of each of the opposing arm frames 68 and 70 are splayed outwardly to form a substantially X-shaped configuration, similar to the base 12. As with the support base 12, alternative configurations, including a substantially H-, I-, Y-, or T-shaped configuration, of the top frame 14 are contemplated to be within the scope of the present invention so long as the configuration is capable of supporting the workpiece 20 when mounted thereon.

The top frame 14 further includes an elongated cross bar or crossmember 16 attached to the short arms 64 at terminal ends thereof such that the crossbar 16 is substantially perpendicular to a central longitudinal axis of opposing arm frames 68 and 70.

Figure 3:
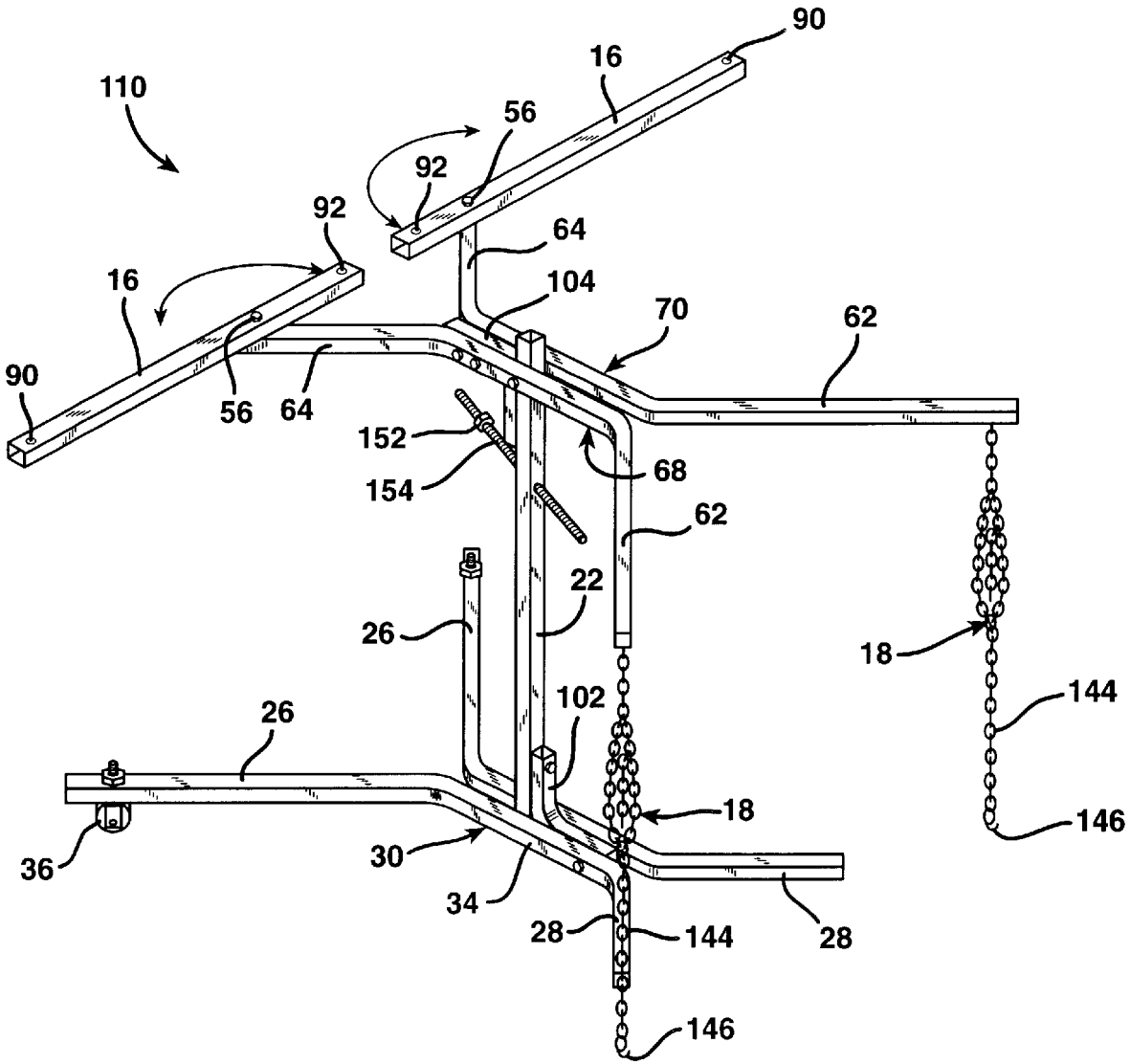
FIG. 3 is an elevated perspective view of an alternate embodiment of the present invention.
Figure 4:
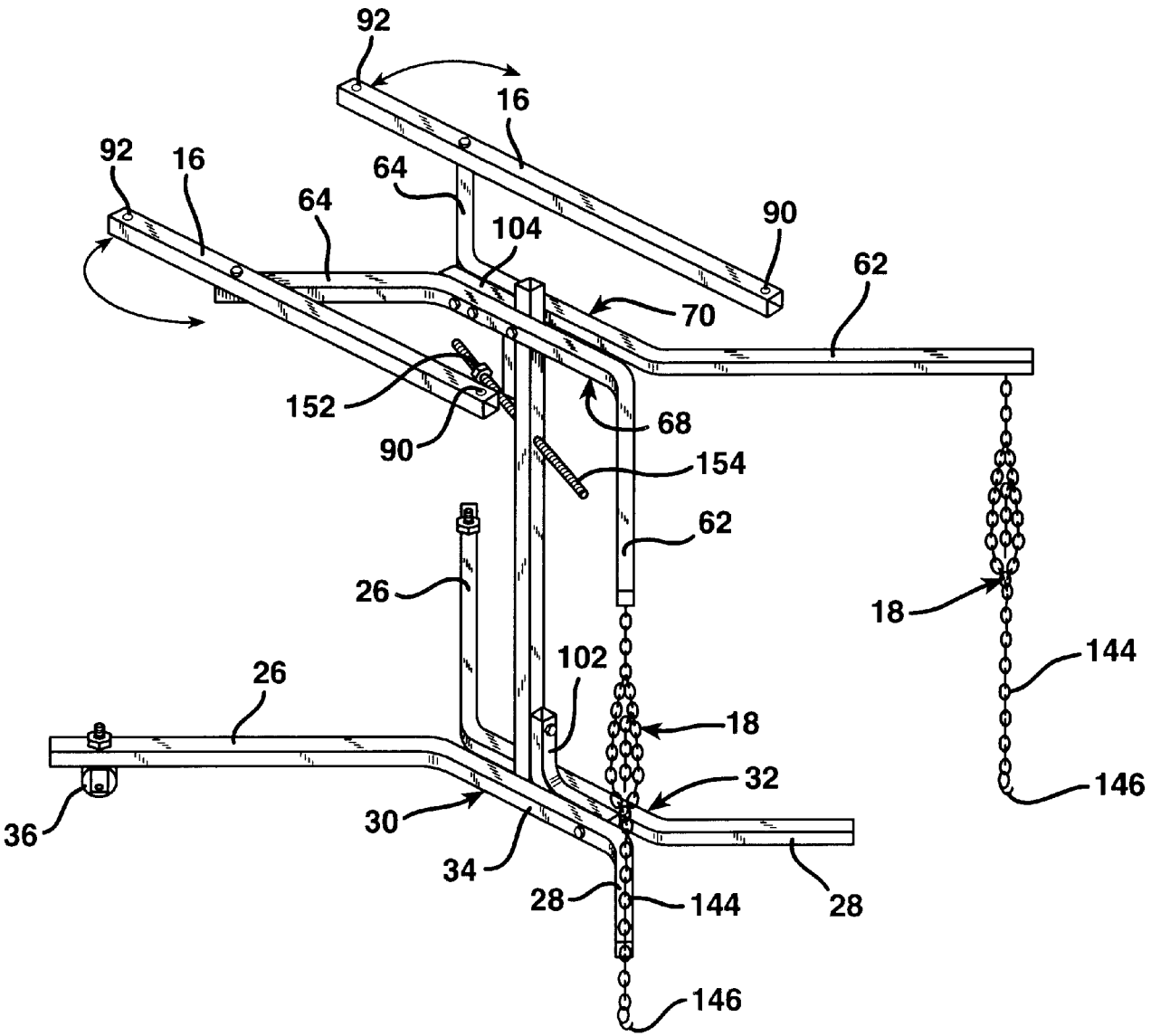
FIG. 4 is an elevated perspective view of the embodiment of FIG. 3 shown with the workpiece support members pivoted into an alternate position.

In an alternate embodiment of the present invention, designated generally by the reference number 110 in FIG. 3, the crossbar comprises two separate crossbars 16, each of which is pivotally attached a terminal end of one of the short arms 64. Accordingly, the two crossbars 16 may be pivoted laterally throughout a range of angular orientations to accommodate workpieces of various configurations (see FIG. 4). In this embodiment, bores 90 and 92 extend through opposing ends of the crossbars 16 for facilitating attachment of the workpiece 20 and the stabilizing device 18 (described below).

The crossbar 16 may be attached to the short arms 64 by fasteners 54, such as threaded bolts 56, extending through aligned bores 74 and 76, and 78 and 80, of the arms 64 and the crossbar 16, respectively. Protruding ends of the threaded bolts 56 cooperatively engage nuts 58. Alternatively, other suitable means of attachment, such as welding, are contemplated to be within the scope of the present invention. Spaced apart ends 82 and 84 of the crossbar 16 may include end caps 86. At least one cushion or pad 88 may be removably disposed about the crossbar 16 to protect a workpiece 20 mounted thereon.

In the preferred embodiment, a pair of axially aligned bores 94 and 96 extend through the central portion 60 of the top frame 14. The bores 94 and 96 are aligned with an axial bore 98 positioned at the upper end 44 of the upright member 22. The bores 94, 96 and 98 are configured to receive a fastener 54, such as a threaded bolt 56 or a pin 100, for pivotally attaching the top frame 14 to the upright member 22.

The top frame 14 may also include a reinforcing member or reinforcing means comprising an L-shaped reinforcing member 104 similar to the reinforcing member 102 of the base 12. In the preferred embodiment, the reinforcing member 104 is interpositioned between the arm frames 68 and 70 of the top frame 14 and is rigidly attached thereto at a first portion of the "L" of the reinforcing member 104. A second portion of the "L" of the reinforcing member 104 extends perpendicularly downward and engages the upright member 22 when the top frame 14 is adjusted to its lowermost position. As described above, the reinforcing member 104 may be attached to the arm frames 68 and 70 by a fastener 54, such as a bolt 56 extending through two pairs of spaced apart, aligned bores 120 and 122, and 124 and 126, positioned at the central portion 60 of the top frame 14, and bores 128 and 130 in the first portion of the reinforcing member 104, respectively. Of course, other suitable means of attachment, such as spot welds, are contemplated to be within the scope of the present invention.

In alternate embodiment 310 shown in FIG. 7, reinforcing member 104 may comprise a pair of spaced apart parallel plates 136 and 138 rigidly mounted to the upright support member 22 by any suitable means of attachment, such as a fastener 54 or weld. In the preferred embodiment a fastener 54, such as a bolt 56, extends through axially aligned bores 140 and 142 of plates 136 and 138, respectively, positioned forward of the upright member 22 to limit the range of downward motion of the top frame 14.

The stabilizing device 18 preferably comprises at least one length of chain 144 having a first end attached to the top frame 14 and a second end attached to the workpiece 20. However, other suitable retaining means, such as a length of cord or cable, are contemplated to be within the scope of the present invention. In the preferred embodiment, a hook 146 is attached at each of the first and second ends of the chain 144. The hook 146 at either the first or second end of the chain 144 is removably attached to the top frame 14, preferably at a terminal end of the long arm 66 of one of the arm frames 68 or 70. Accordingly, the hook 146 at the remaining free end of the chain 144 is removably attached to the workpiece 20.

As shown in FIG. 1, the preferred embodiment includes two lengths of chain 144, each attached at one end to the terminal ends of long arms 66 and attached at its free end to the workpiece 20. A hook 148 is attached to the chain 144 intermediate the ends for eliminating any slack in the chain 144 when it is attached to the workpiece 20. Accordingly, a free end of the hook 148 is attached to the chain 144 at a point along its length which will render it taut.

In the preferred embodiment, the adjustment mechanism 150 comprises a threaded rod 154 having a cooperatively threaded retaining nut 152 positioned intermediate spaced apart ends. An axial bore 156, which is configured to receive one end of the threaded rod 154 and which is aligned along a central longitudinal axis of opposing arm frames 68 and 70 of the top frame 14, extends angularly upward through the upright support member 22 intermediate the ends 44 and 46. The second portion of the reinforcing member 104 includes a bore 158 aligned along the same axis as the angularly disposed bore 156 of the upright support member 22 for receiving the other end of threaded rod 154. The retaining nut 152 is positioned on the threaded rod 154 to abut the upright support member 22 between the upright member 22 and the second leg of the reinforcing member 104.

The apparatus may also include an optional adapter 160 for facilitating the mounting of various types of workpieces 20. The adapter 160 of the preferred embodiment includes at least one hollow sleeve 162 having an interior configured to slidably engage the crossbar 16 of the top frame 14. A post 164 on which a workpiece 20 may be positioned extends angularly upward from the sleeve 162. The adapter 160 may further include a fastener comprising a threaded screw or bolt 166 extending through a threaded bore 168 in a wall of the sleeve 162. Accordingly, the screw 166 may be tightened causing it to bear against the crossbar 16 when operatively installed thereon to prevent lateral movement of the sleeve 162 along the crossbar 16.

Figure 5:
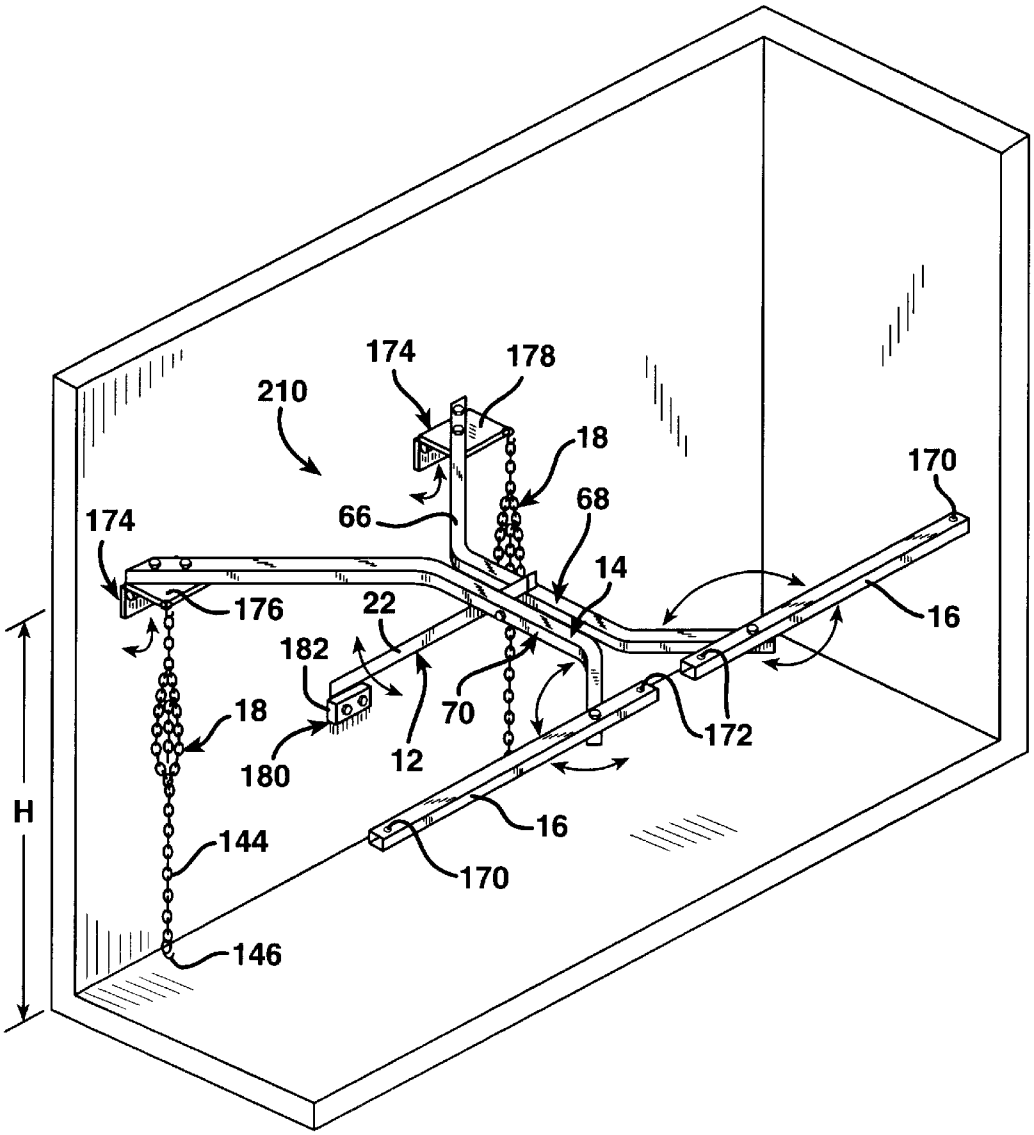
FIG. 5 is an elevated perspective view of an alternate embodiment of the present invention shown in an operable position.

With reference to FIG. 5, an alternate embodiment of the present invention is designated generally by reference number 210. Alternate embodiment 210 includes a support base 12 comprising an elongated support member 22 attached to a top frame 14. In the preferred embodiment, the top frame 14 further comprises oppositely disposed arm frames 68 and 70 having at least one arm extending therefrom. Similar to the embodiments described above, the arms of the arm frames 68 and 70 form a first pair 64 and a second pair 66 of spaced apart arms extending angularly outward therefrom forming a substantially X-shaped configuration. The second pair of arms 66 are preferably longer than the first pair of arms 64. Of course, as previously explained, other configurations of the top frame 14 are contemplated to be within the scope of the present invention, including H-, I-, Y-, or T-shaped configurations.

A crossbar 16 is attached to a terminal end of each of the first pair of arms 64. The crossbar 72 may comprise a single crossbar or two separate crossbars, each of which is pivotally attached to the terminal end of each of the first pair of arms 64. Bores 170 and 172 extend through opposing ends of the crossbar or crossbars for facilitating attachment of the workpiece 20 and the stabilizing device 18 (described hereinabove), respectively.

Terminal ends of the second pair of arms 66 are pivotally attached to a bracket 174 capable of being mounted to a wall or other vertical support surface so that the apparatus may be raised to an operable position or lowered to a collapsed position. The bracket 174 may further comprise a pair of hinges 176 and 178 operatively mounted to the terminal ends of the second pair of arms 66 and the wall or support surface. The bracket 174 is mounted at a height H slightly greater than the separating distance between the crossbar and an opposite end of the top frame 14 or the lower end 46 of the upright member 22, whichever is longer.

Figure 6:
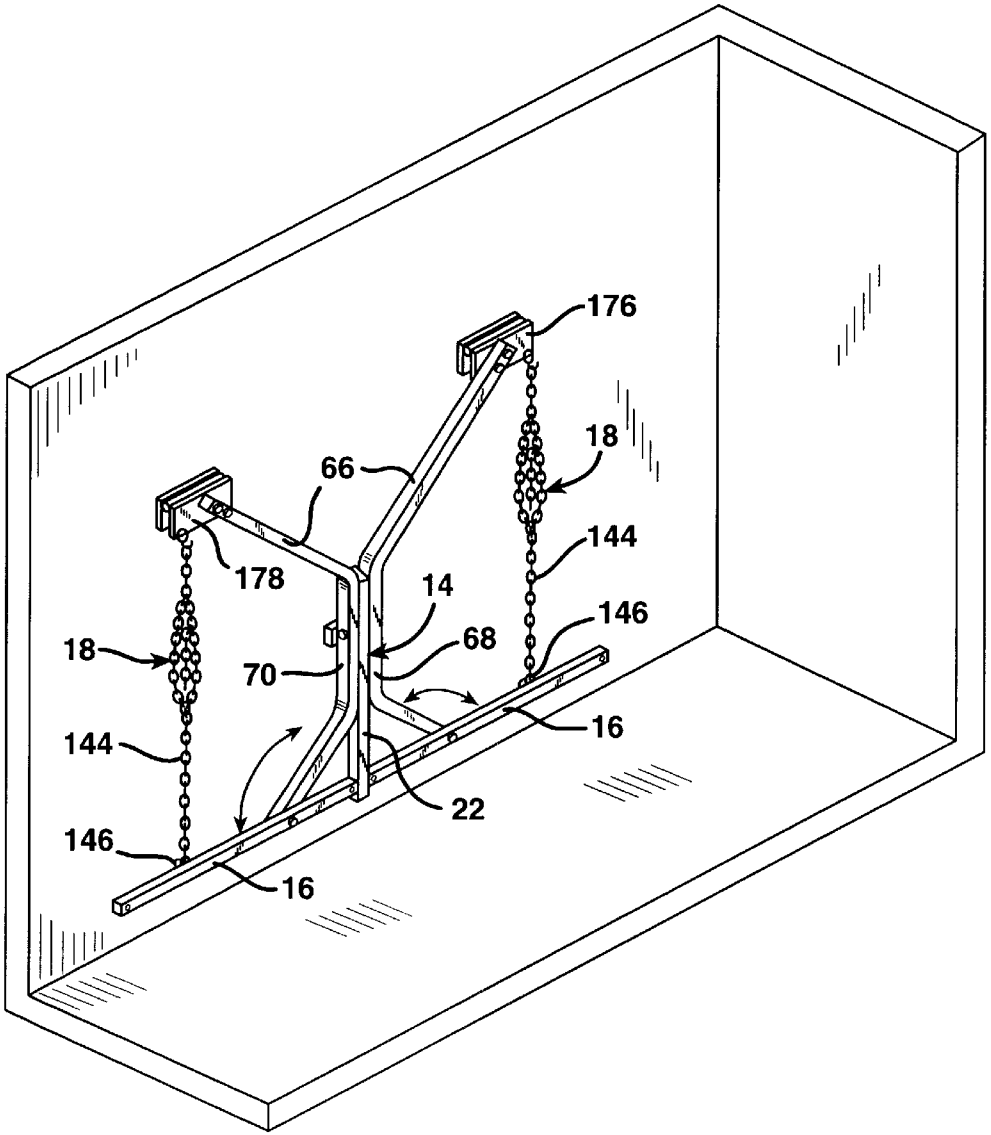
FIG. 6 is an elevated perspective view of the embodiment of FIG. 5 shown in a collapsed position.

A leg rest 180, preferably comprising a bracket 182 configured to receive the lower end 46 of the upright support member 22 and operatively mounted on the wall or support surface, may be provided. As shown in FIG. 6, alternate embodiment 210 may be collapsed by disengaging the upright member 22 from the leg rest means 180 such that the apparatus is substantially flush with the wall or support surface when not in use.

MODE OF OPERATION

In use, a workpiece 20, such as an automobile bumper as indicated in phantom, is mounted on the top frame 14 as shown in FIGS. 1 and 7, and is secured thereto by the stabilizing device 18. Accordingly, one of the hooks 146 at one of the ends of each chain 144 is attached to a long arm 66 of the top frame 14. The hook 146 at the free end of each chain 144 is attached to the workpiece 20. The hooks 148 positioned intermediate the ends of each chain 144 may be attached to the chains 144 at appropriate points to eliminate any slack. The cushions or pads 88 may be attached to the crossbar 16 prior to mounting the workpiece 20 thereon if so desired.

The adapter 160 may be mounted on the crossbar 16 to facilitate the mounting of workpieces 20 that may not otherwise be readily mounted thereon.

When the workpiece 20 is properly secured to the top frame 14, the elevation and angular orientation of the workpiece 20 may be adjusted using the adjustment means 150 to pivot the top frame 14 through a range of angles about its pivotal connection to the upright member 22. Accordingly, the retaining nut 152 is positioned on the threaded rod 154 to achieve the desired position of the workpiece 20. A lower end of the threaded rod 154 is then inserted into bore 156 of the upright member 22. An upper end of the threaded rod 154 is inserted into the aligned bore 158 positioned at the second portion of the reinforcing member 104. The weight of the workpiece 20 will cause the retaining nut 152 to bear against the upright member 22 to hold the workpiece 20 in the desired position.

To make further adjustments of the position of the workpiece 20, the top frame 14 may be lifted to disengage the threaded rod 154 from the bores 158 and 156 in the reinforcing member 104 and the upright member 22, respectively. The retaining nut 152 may then be repositioned to achieve the desired elevation and angular disposition of the workpiece 20.

The top frame 14 may be adjusted to its lowermost position by simply removing the threaded rod 154 altogether. Accordingly, the downwardly projecting leg of reinforcing member 104 would bear directly against the upright member 22 so that the workpiece 20 would assume a substantially horizontal orientation.

These and other embodiments and equivalents of the present invention shall become apparent after consideration of the scope of the specification and drawings. All such embodiments and equivalents are contemplated as part of the present invention even though not specifically set forth herein, and whose only limitation is the scope of the appended claims.

What is claimed is:

1. An apparatus for supporting a workpiece comprising:

a support base;

a top frame pivotally attached to said support base, said top frame comprising a central portion and a pair of spaced apart arms extending therefrom;

said pair of spaced apart arms further comprising first ends that extend angularly outward from said central portion and away from each other and second ends that extend angularly outward from said central portion in a direction opposite from said first ends and away from each other;

a crossbar attached to each of the second ends of said pair of spaced apart arms; and a stabilizing device to secure the workpiece to said top frame.

2. The apparatus of claim 1 wherein said support base further comprises:

an upright support member attached at its upper end to said central portion.

3. The apparatus of claim 2 wherein said support base further comprises:

a plurality of spaced apart legs extending angularly outward from its opposite end.

4. The apparatus of claim 3 further comprising:

pivot means for pivotally attaching said top frame to said upright support member.

5. The apparatus of claim 4 further comprising:

an adjustment mechanism enabling the top frame to be positioned in a plurality of user selectable orientations with respect to said upright support member.

6. The apparatus of claim 5 wherein said adjustment mechanism further comprises:

a rod having spaced apart ends;

a retaining member positioned on said rod intermediate the spaced apart ends;

wherein one end of the rod is received within an axial bore in said upright support member and the other end of said rod is received within an aligned bore in said central portion of the top frame.

7. The apparatus of claim 6 further comprising:

a stabilizing device attached to the apparatus for stabilizing the workpiece positioned thereon.

8. The apparatus of claim 7 wherein said stabilizing means comprises at least one chain; and attachment means for removably attaching the chain to said top frame and the workpiece.

9. The apparatus of claim 8 further comprising cushion means removably attached thereto for protecting the workpiece.

10. The apparatus of claim 9 further comprising an adapter removably mounted to said crossbar to aid in positioning the workpiece.

11. The apparatus of claim 10 further comprising a wheel system attached to said pair of spaced apart legs.

12. The apparatus of claim 2 wherein brackets are attached to said second ends for connecting said top frame to a vertical support surface.

13. The apparatus of claim 1 wherein said crossbar comprises two separate crossbars, each separate crossbar being attached to said first ends such that they are aligned along an axial path.

14. The apparatus of claim 1 wherein the workpiece is a bumper.

* * * * *

UNITED STATES PATENT AND TRADEMARK OFFICE

CERTIFICATE OF CORRECTION

PATENT NO. : 6,109,600
DATED : August 29, 2000
INVENTOR(S) : Brian P. Yost et al.

It is certified that error appears in the above-identified patent and that said Letters Patent is hereby corrected as shown below:

Title page,
Item [73] Assignee, should read as follows: -- Robert J. Budesa, Hermitage, Tenn. --.

Signed and Sealed this

Sixth Day of August, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,109,600
DATED : August 29, 2000
INVENTOR(S) : Brian P. Yost et al.

It is certified that error appears in the above-identified patent and that said Letters Patent is hereby corrected as shown below:

Title page,
Item [73], the Assignee should read as follows:

-- [73] Assignee: Brian P. Yost, Nashville; Robert J. Budesa, Hermitage, both of Tenn. --.

This certificate supersedes the Certificate of Correction issued August 6, 2002.

Signed and Sealed this

Eighth Day of October, 2002

*Attest:*

*Attesting Officer*

JAMES E. ROGAN
*Director of the United States Patent and Trademark Office*